US007223219B2

(12) United States Patent
Liester

(10) Patent No.: US 7,223,219 B2
(45) Date of Patent: May 29, 2007

(54) FRICTIONAL VARIABLE RESISTANCE EXERCISE DEVICE

(76) Inventor: Arvin Floyd Liester, 17950 Martingale Rd., Monument, CO (US) 80132

( * ) Notice: Subject to any disclaimer, the term of this patent is extended or adjusted under 35 U.S.C. 154(b) by 277 days.

(21) Appl. No.: 11/114,695

(22) Filed: Apr. 26, 2005

(65) Prior Publication Data

US 2005/0221964 A1 Oct. 6, 2005

Related U.S. Application Data

(63) Continuation-in-part of application No. 10/812,677, filed on Mar. 30, 2004.

(51) Int. Cl.
*A63B 21/00* (2006.01)

(52) U.S. Cl. ..... 482/126; 482/114; 482/904

(58) Field of Classification Search ..... 482/126, 482/121, 93, 129, 130, 14, 904, 907, 95, 482/104–108, 94

See application file for complete search history.

(56) References Cited

U.S. PATENT DOCUMENTS

| | | | | |
|---|---|---|---|---|
| 770,994 | A | 9/1904 | Tierney | |
| 1,572,802 | A | 2/1926 | Layman | |
| 2,134,451 | A | 10/1938 | Mogren | |
| 2,918,282 | A | 12/1959 | Waterval | |
| 3,197,204 | A | 7/1965 | Holkesvick et al. | |
| 3,506,262 | A | 4/1970 | Wade | |
| 3,510,132 | A | 5/1970 | Holkesvick | |
| 3,550,449 | A | 12/1970 | Henson | |
| 3,650,531 | A * | 3/1972 | Pridham | 482/120 |
| 3,656,745 | A * | 4/1972 | Holkesvick | 482/120 |
| 3,704,886 | A | 12/1972 | Kay et al. | |
| 3,858,873 | A | 1/1975 | Jones | |
| 3,869,121 | A | 3/1975 | Flavell | |
| 3,915,452 | A | 10/1975 | Winblad | |
| 4,072,308 | A | 2/1978 | Applegate | |
| 4,077,626 | A | 3/1978 | Newman | |
| 4,109,907 | A | 8/1978 | Zito | |
| 4,311,218 | A * | 1/1982 | Steffen | 188/65.4 |
| 4,343,466 | A | 8/1982 | Evans | |
| 4,402,504 | A | 9/1983 | Christian | |
| 4,529,191 | A | 7/1985 | Miller et al. | |
| 4,557,480 | A | 12/1985 | Dudley | |
| 4,560,160 | A * | 12/1985 | Smith | 482/120 |
| 4,619,453 | A | 10/1986 | Plumridge | |
| 4,624,457 | A | 11/1986 | Silberman et al. | |
| 4,634,127 | A | 1/1987 | Rockwell | |
| 4,645,204 | A | 2/1987 | Berger | |

(Continued)

*Primary Examiner*—Jerome Donnelly
(74) *Attorney, Agent, or Firm*—Leyendecker & Lemire, LLC; Kurt Leyendecker

(57) ABSTRACT

Accordingly to one embodiment, an exercise device comprising a T-shaped cylindrical member with an associated mounting assembly that permits the device to be removably mounted to the edge of a door and utilized when the door is closed is described. When an elongated rope with handles at its ends is wrapped around the T-shaped cylindrical member in the desired configuration, a significant amount of resistance to movement of the rope is provided. In one preferred form of exercising using the device, the exerciser provides a small counter force to the handle being held by the arm that is not being exercised and the resulting force necessary to move the handle and rope with the arm being exercised is a much greater than the small counter force as a result of the multiplier effect of the wrapping of the rope around the T-shaped cylindrical member.

9 Claims, 9 Drawing Sheets

U.S. PATENT DOCUMENTS

| | | | | |
|---|---|---|---|---|
| 4,659,077 | A | | 4/1987 | Stropkay |
| 4,728,103 | A | | 3/1988 | Fulton |
| 4,852,873 | A | | 8/1989 | O'Donnell et al. |
| 4,867,445 | A | | 9/1989 | Connelly |
| 4,944,511 | A | | 7/1990 | Francis |
| 5,037,087 | A | | 8/1991 | Roth |
| 5,050,869 | A | | 9/1991 | Frate |
| 5,154,684 | A | | 10/1992 | Delf |
| 5,195,937 | A | | 3/1993 | Engel et al. |
| 5,217,092 | A | * | 6/1993 | Potter ..... 188/65.4 |
| 5,352,172 | A | * | 10/1994 | Suzaki ..... 482/120 |
| 5,385,525 | A | | 1/1995 | Davis |
| 5,417,628 | A | | 5/1995 | Vanderbleek |
| 5,429,563 | A | | 7/1995 | Engel et al. |
| 5,496,236 | A | | 3/1996 | Buonauito |
| 5,626,546 | A | | 5/1997 | Little |
| 5,700,232 | A | | 12/1997 | Clausen et al. |
| 5,725,459 | A | | 3/1998 | Rexach |
| 5,752,903 | A | | 5/1998 | Chang |
| 5,776,033 | A | | 7/1998 | Brown |
| 5,876,310 | A | | 3/1999 | Mackey et al. |
| 6,241,641 | B1 | | 6/2001 | Sawyer |
| 6,315,701 | B1 | | 11/2001 | Shifferaw |
| 6,328,679 | B1 | | 12/2001 | Croft |
| 6,508,743 | B1 | | 1/2003 | Fortin |

* cited by examiner

FRICTIONAL VARIABLE RESISTANCE EXERCISE DEVICE

RELATED APPLICATIONS

This application claims is a Continuation-In-Part of and incorporates herein in its entirety the non-provisional application Ser. No. 10/812,677 filed on Mar. 30, 2004 entitled "Frictional Resistance Exercise Apparatus", and having the same inventor as this application.

FIELD OF THE INVENTION

This invention relates to exercise equipment.

BACKGROUND

In the past 15 to 30 years, exercise and weight training has become very popular. Traditional weight training typically uses free weights to maximize the amount of work done by a targeted group of muscles. Typically, the weights are attached to barbells, which a user moves in a desired manner to exercise the targeted muscles. Because the weights are not restrained but merely held by the user, there is a significant risk of injury to the user or someone else nearby if the user accidentally let's go of the weights. Furthermore, dropped weights can cause damage to floors and other surrounding surfaces. Another disadvantage of free weights is that a user can strain or otherwise injure his or her muscles if his or her technique of using the weights is improper.

For reasons of safety and convenience, weights have been incorporated into mechanical gyms wherein the user pulls or pushes on handles to raise or lower a set of weights connected to the handles by way of pulleys and cables. These gyms often require substantial support structures to contain the weights and direct the cables and pulleys. Accordingly, these gyms are usually bulky and heavy and are not particularly suited for use in residences, especially smaller residences, such as apartments, where space is at a premium. Additionally, these gyms are relatively expensive and tend to provide resistance in a single plane only versus the multi-plane and multi-directional resistance to movement permitted when a device having a rope pull is utilized.

In the recent past, a number of exercise gyms and apparatus that do not use weights have found their way into the marketplace. To provide the necessary resistance to work muscles these gyms and apparatus rely upon various types of load inducing mechanisms. Some typical mechanisms include springs, elastomeric bands, resilient rods, pneumatic or hydraulic cylinders, wind resistance and magnetic and electronic load resistance mechanisms. In general, the devices relying on alternative load inducing mechanisms also require a framework or support structure although the framework is often much more compact and lighter than the framework of a gym utilizing weights making it more suitable for use in a residence. Nevertheless, such devices still typically require a substantial amount of space.

The most compact of home exercise devices are those that utilize gravity in combination with a user's own weight to provide the necessary load to work the user's muscles. These devices, however, are limited in the amount of load or resistance that can be applied to particular muscle group.

A number of devices have been proposed that utilize frictional resistance to provide an exercise load, such as the devices described in U.S. Pat. Nos. 4,343,466 ('466), 4,560,160 ('160), 5,352,172 ('172), 3,510,132 ('132). Generally, each of these devices includes one or more handles or grips that are attached to a rope which is wrapped around a friction inducing member. While relatively compact these devices are not adapted to be particularly portable. Both '160 and '172 teach attaching the respective devices to a stud or jamb in a wall using screws or some other permanent or semi-permanent fastening means. This is especially disadvantageous to apartment dwellers or others who cannot or do not want to permanently fix something to the walls or floor of their residence. They are also not particularly easy to use potentially requiring a significant amount of time to either thread, remove or change the frictional resistance of the rope. Further, they are only suitable for exercises related to their mounting location. For instance, when the devices are mounted close to the ground, they can be used for curls but they cannot be used for curls when mounted higher on a wall. In order to use the same device for exercises requiring different mounting locations either multiple devices must be provided or at the very least multiple mounting brackets must be affixed to a wall.

Similarly to the devices discussed in the proceeding paragraph, the devices of the '132 and '466 patents do not facilitate easy rope placement, removal and frictional resistance changes. These two patents teach straps attached to the devices to permit the devices to be removably secured to a rigid structure but there are not too many rigid structures in a typical single family home, apartment or hotel room to which a strap can be wrapped and secured. Neither of these devices provides a convenient means for easily and removably securing the devices to a portion of a residential structure, such as a door or doorway. Further both the '132 and '466 devices, as well as, '172 device are fabricated from a solid metallic material that when used continuously for a period of time during exercise could become quite hot due to the frictional energy thereby causing the associated rope to degrade.

DETAILED DESCRIPTION

Figure 1:
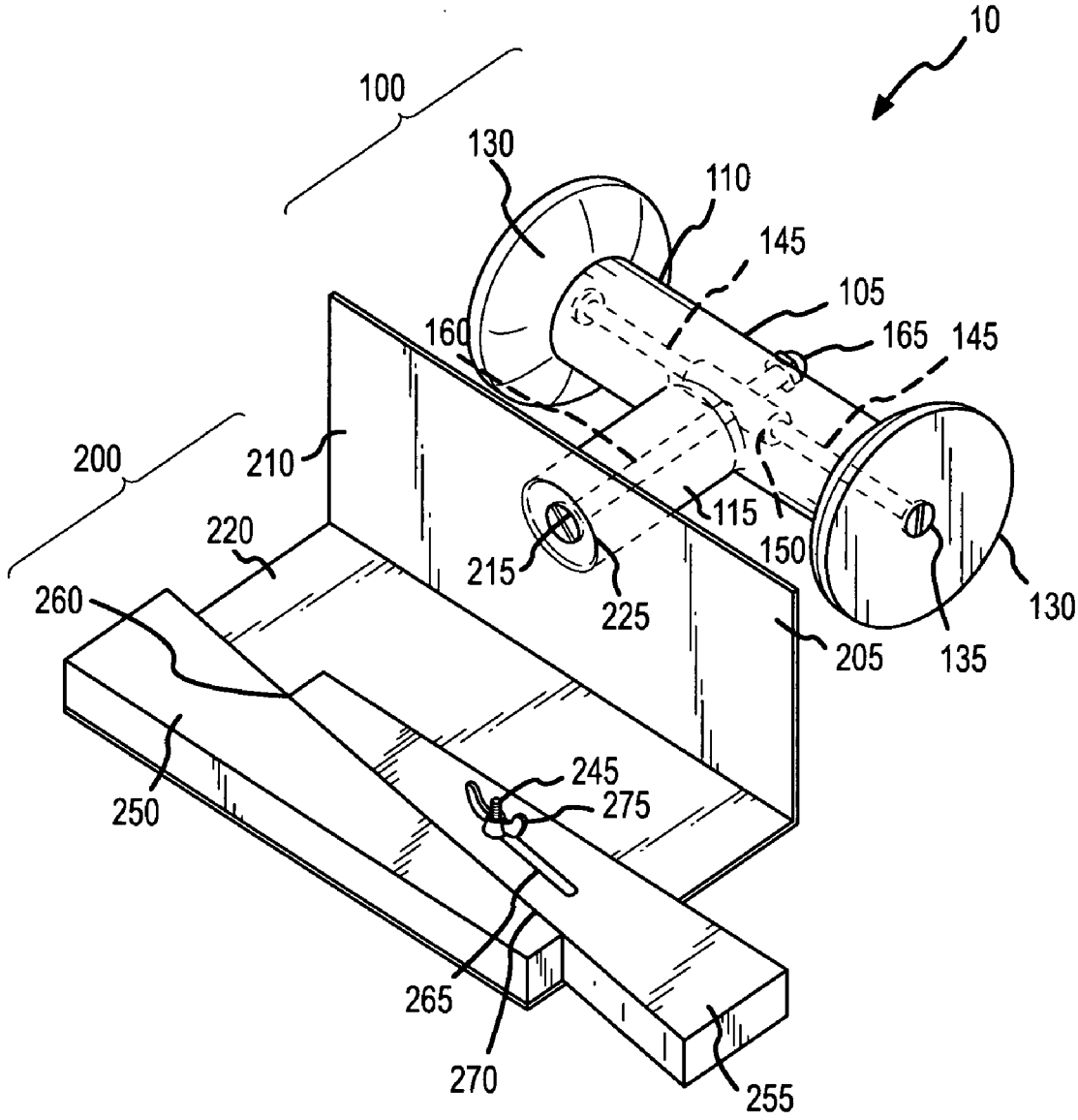
FIG. 1 is an isometric view of the first resistance apparatus according to one embodiment of the present invention.

Embodiments of a compact, portable, low cost and lightweight exercise device are described. Embodiments of the invention utilize a T-shaped cylindrical member, such as a copper plumbing tee, around which a rope is wrapped to provide a frictional force multiplier when a counter force is applied to the end of the rope that is opposite the end being utilized in a particular exercise. For example, using a rope with handles on both ends that is wrapped around the T-shaped member, an exerciser pulls on one handle with the arm being exercised while providing a small resistive counter force through the other handle using the other arm. Because of the multiplier effect of the frictional resistance provided by the T-shaped cylindrical member, the effective force required for the exercising hand/arm to pull the rope is much greater than the resistive force applied to the rope's other end. The multiplicative effect of the T-shaped member can be quickly and easily adjusted depending on how the rope is wrapped around the T-shaped cylindrical member.

Because the level of resistance and force required to move the rope is dependent on the force applied by the exerciser's other hand, the exerciser can dynamically, actively and instantaneously vary the amount of resistance without reconfiguring the device. An exerciser can maximize the effectiveness of a workout by: (i) increasing the rope's resistance to movement when the arm being exercised is in a suitable position to apply a relatively large maximum force; and (ii) reducing the rope's resistance to movement when the exercising arm is in a position wherein it can not apply as great a force. In contrast, using prior art static resistance exercise devices, the amount of resistance, must be set using weights or other resistance inducing means to a level that that permits the exerciser to complete an exercise cycle or stroke through the weaker portions of the cycle or stroke. As discussed at www.strengthcats.com/VariableVsStandard.htm, studies have indicated the superiority of dynamic variable resistance. The materials in the above referenced web article explain the dynamic variable resistance concept:

> In conventional resistive exercises, loads are moved through a range of motion. The muscular force and the load are not constant because of the modifying effects of the lever system throughout the range of motion. In an exercise such as the bench press, for example, the resistance achieves maximum effect at a specific point, and becomes less anywhere above or below that point. This illustrates a phenomenon; that the muscle works at maximum potential during a very small range of motion throughout an exercise stroke. To facilitate maximum muscular involvement, you must vary the resistance. In some exercises, this resistance must be varied as much as 100% in order to maintain the maximum moment of force. The resistance must be varied according to biomechanical data obtained under dynamic conditions.

Further using embodiments of the present invention, an exerciser can, depending on how little or how much resistance he/she applies with the other hand, use the device for aerobic or strength training. The device also encourages the development of coordination between the opposing hands and arms, especially during an aerobic workout, wherein one arm alternately provides resistance while the other alternatively performs an exercise stroke or cycle.

The use of a T-shaped cylindrical member and end stop members in certain variations and embodiments of the invention facilitates the use of the device in more than a single plane or dimension. For instance, if the exerciser pulls upwardly or downwardly on the rope, the T-shaped cylindrical member imparts a frictional resistive force on the rope relative to the counter force applied by the exerciser's other hand. If the exerciser pulls horizontally outwardly on the rope with one hand, a frictional resistive force is imparted to the rope as well. Finally, the exerciser can pull the rope generally sideways at a small acute angle relative to the arms of the T-shaped cylindrical member and the single leg of the member along with the flared end stop members prevent the rope from sliding off the member while still providing a frictional resistance force to the rope. This in contrast to many prior art exercise machines that utilize levers rotating about an axle that do not permit the handles of the device to be pulled or pushed in more than one plane thereby limiting the exerciser's flexibility during a workout.

One embodiment of the device is configured to be fitted either over the top or bottom side of a door in a manner that permits the door to be open and closed freely while the device is attached. The determination as to whether to place it over the top or under the bottom of the door is made based on the exercises to be performed. Once the door is closed the unit is effectively locked in place allowing the exercisers to perform his/her workout. Attachment of the device to the door does not require the permanent mounting of the device or any peripheral bracketry or hardware. Accordingly, the unit can easily be moved between the top and bottom of the door as well as other doors. Its relatively small size makes the device extremely portable such that it fits into a suitcase or other travel bag to permit a user to perform his/her workout while traveling.

Other embodiments of the device are designed for use in situations where the device can be more permanently attached to, for example, a floor or a wall, and include a suitable mounting means. In all embodiments, the T-shaped cylindrical member is utilized. In preferred variations of the various embodiments, the T-shaped cylindrical member is comprised of a hollow copper tee similar to the type used in plumbing. As can be appreciated, a significant amount of frictional heat can be built up on the surface of the T-shaped cylindrical member during use especially during an aerobic exercise routine. The temperature if it becomes high enough can have deleterious effects on the rope wrapped therearound. By using copper with its very high thermal conductivity, the heat can be more effectively dissipated than if other materials are used. Furthermore, by using a hollow member, water can be placed in the T-shaped member's interior to provide for additional cooling. By minimizing the temperature of the T-shaped cylindrical member, the longevity of the associated rope can be maximized.

The advantages of the present invention and its various embodiments and the specific embodiments illustrated in described herein are not intended to be construed as limiting. Rather, numerous variations have been contemplated that read upon the appended claims and are intended to be within the scope of the invention.

Terminology

The term "or" as used in this specification and the appended claims is not meant to be exclusive rather the term is inclusive meaning "either or both".

References in the specification to "one embodiment", "an embodiment", "a preferred embodiment", "an alternative embodiment" and similar phrases means that a particular feature, structure, or characteristic described in connection with the embodiment is included in at least an embodiment of the invention. The appearances of the phrase "in one embodiment" in various places in the specification are not necessarily all referring to the same embodiment.

The term "coupled" refers to two or more elements that are connected together but not necessarily directly connected together. For example, a rope is coupled to a support member even if the rope is not in direct contact with the support member if there is an intervening element or set of elements that are connected to both the rope and the support member.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

As applicable, the terms "about" or "generally" as used herein unless otherwise indicated means a margin of +−20%. Also as applicable, the term substantially as used herein unless otherwise indicated means a margin of +−10%. It is to be appreciated that not all uses of the above terms are quantifiable such that the referenced range can be applied.

The term "rope" as used herein refers to any flexible elongated material or combination of materials that has a length that is typically at least in order of magnitude greater than the material's width. Accordingly, "rope" includes, but is not limited to, cord, cable, wire and twine.

The term "T-shaped cylindrical member" as used herein refers to any cylindrical element that has a protrusion extending generally perpendicularly therefrom. The protrusion may be cylindrical in shape as well. Typically, the protrusion extends from proximate a center location along the length of the cylindrical member. In one preferred embodiment, the T-shaped cylindrical member comprises a copper tee and associated copper piping, such as is typically used in plumbing applications. The copper pipe permits the rapid dissipation of heat generated as the rope frictionally slides along the surface of the cylindrical portion and the protruding portion of the T-shaped cylindrical member.

A FIRST EMBODIMENT OF A RESISTANCE EXERCISE DEVICE

One embodiment of a first resistance exercise device 10 is illustrated in FIGS. 1-4. It is configured for attachment to the top or bottom of a door for use when the door is closed. The device comprises: (i) a T-shaped cylindrical member assembly 100 that includes the T-shaped cylindrical member 105; (ii) a door mount assembly 200 which is securely attached to the T-shaped cylindrical member assembly and facilitates the attachment of the device a suitable door; and (iii) a rope assembly 300 (see FIG. 4) that typically includes two handles 305 at either end and is adapted to be wrapped around the T-shaped cylindrical member proximate its midpoint.

Figure 3:
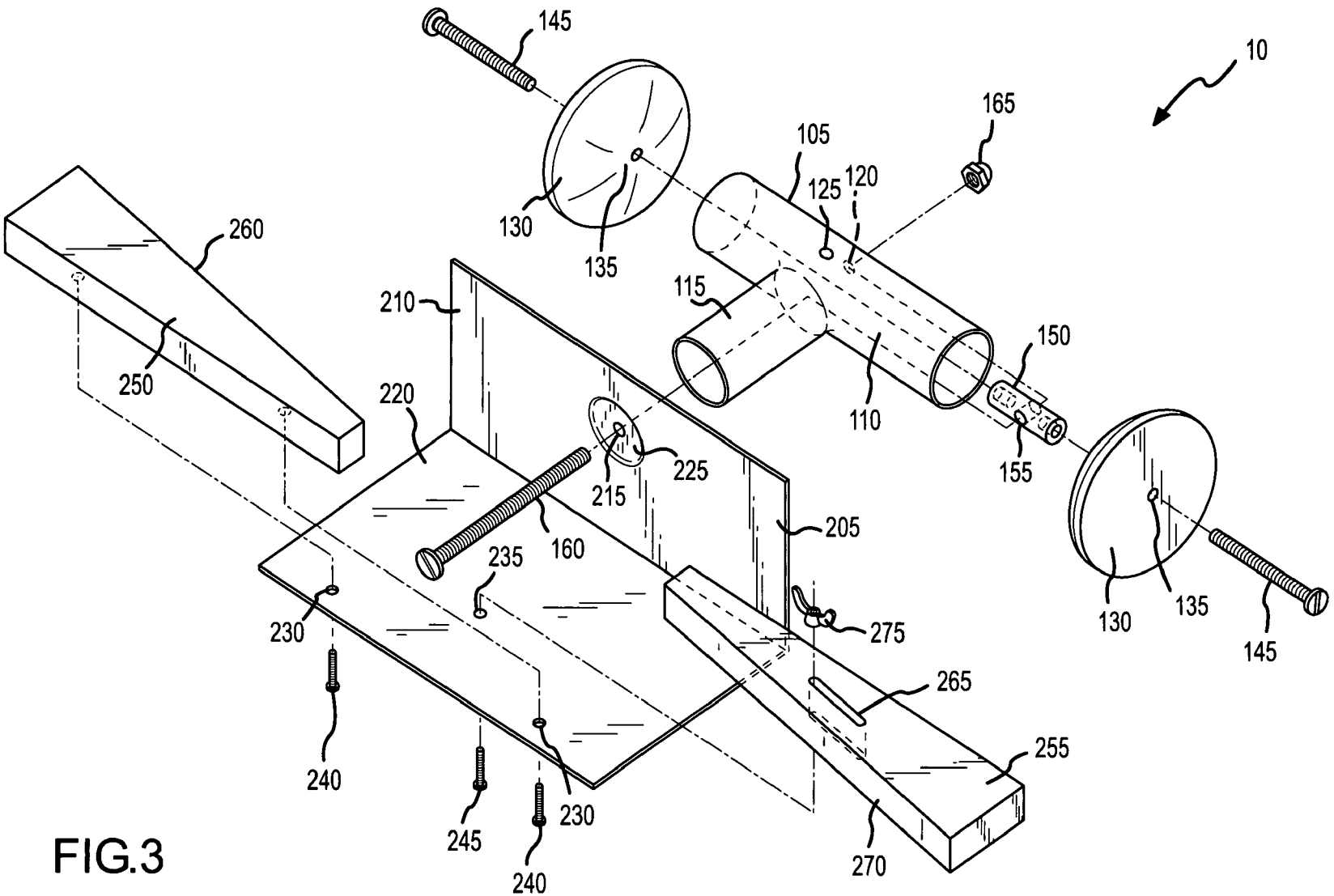
FIG. 3 is an exploded isometric view of the first resistance apparatus according to one embodiment of the present invention.

The various components of the T-shaped cylindrical member assembly 100 are best illustrated in FIG. 3. The heart of the assembly is the T-shaped cylindrical member 105. The T-shaped cylindrical includes first and second integrally formed tubular sections 110&115. The first tubular section 110 forms left and right arms, and the second tubular section 115 forms a leg that is joined to and extends from the proximate middle of the first tubular section. It is around the intersection of the two tubular sections that the rope assembly 300 is wrapped to cause the desired frictional force multiplier during exercise. The left and right ends of the first tubular section and the bottom end of the second tubular section are open. Further, the T-shaped cylindrical member includes a bolt hole 120 extending through the first tubular section proximate its middle wherein the center of the bolt hole is proximally aligned with the longitudinal center axis of the second tubular section. A portion of a threaded fastener is received through the bolt hole to secure the T-shaped cylindrical member to the door mount assembly 200 as is described in greater detail below.

One or more access holes may also be provided in the T-shaped cylindrical member, such as the illustrated access hole 125 located proximate the intersection of the first and second tubular sections. The one or more access holes permit a user to inject a small amount of water into the interior of the T-shaped cylindrical member. Accordingly, as the T-shaped cylindrical member heats up during exercise, the frictional heat energy is transferred to the water, which in turn may vaporize to further dissipate the heat energy. A rubber stopper or cap (not shown) can be provided to prevent the water from leaking out of the hole when the device is inverted.

The T-shaped cylindrical member assembly 100 also includes end stop members 130 that butt up against the respective left and right ends of the first tubular section 110. Each end stop member is typically circular and has a fastener hole 135 drilled through it. The fastener hole is on the center of each end stop member. A sufficient distance is provided between the edge of the end stop member and the vertical side 210 of the L-bracket 205 (described in detail below) to permit a user to slide a rope therebetween when wrapping the rope about the T-shaped cylindrical member.

The end stop members 130 are secured to the T-shaped cylindrical member 105 by left and right fasteners 145 that extend into the hollow interior of the left and right arms respectively of the first tubular section 110. Approximately at the interior midpoint of the first tubular section, a threaded coupling nut 150 is provided into which both fasteners are received and threadably secured. As best shown in FIG. 3, the coupling nut includes a hole 155 extending through the nut perpendicularly to the threaded passageway. The hole is located generally at the longitudinal center of the coupling nut and is sized to permit a threaded mounting fastener 160 to pass therethrough.

The threaded mounting fastener 160 passes (i) through an opening 215 in the vertical side 210 of the L-bracket 205, (ii) through the open bottom end of the second tubular section 115, and (iii) through the bolt hole 120 preferably directly opposite the second tubular section's intersection with the first tubular section. An acorn nut 165 is threaded onto the protruding end of the fastener. When tightened and secured the mounting fastener effectively holds the bottom end of the second tubular section against the outside face of the L-bracket's vertical side.

The L-bracket 205 typically comprises an elongated piece of sheet material having a horizontal side 220 and the vertical side 210. The sheet material is most preferably comprised of steel but in variations can comprise aluminum, other metals or even a reinforced plastic material. The sheet material is typically thin enough that the associated door can be closed when the exercise device is mounted over or under the door.

As mentioned above, an opening 215 is provided proximate the left right center of the side through which the mounting fastener 160 can be received. As shown in FIG. 3, the sheet material is substantially planar but an indentation 225 is provided surrounding the opening such that the head of the mounting fastener is recessed. Accordingly, the top of the fastener's head is flush with or recessed relative to the back surface of the vertical side and the fastener head does not mar or cause damage to the associated door's surface when the device is installed and being used.

The horizontal side 220 of the L-shaped bracket is also substantially planar and typically includes a plurality of mounting holes 230&235 through which treaded fasteners 240&245 are received to secure one or two wedge blocks 250&255 to the L-shaped bracket. The outer wedge block 250 is typically immovably secured to the horizontal side using two or more threaded fasteners 240 passing through the associated mounting holes 230. The side or surface 260 of the block directly facing the L-bracket's vertical side 205 is slightly canted forming a shallow acute angle relative to the L-bracket's vertical side.

Figure 2:
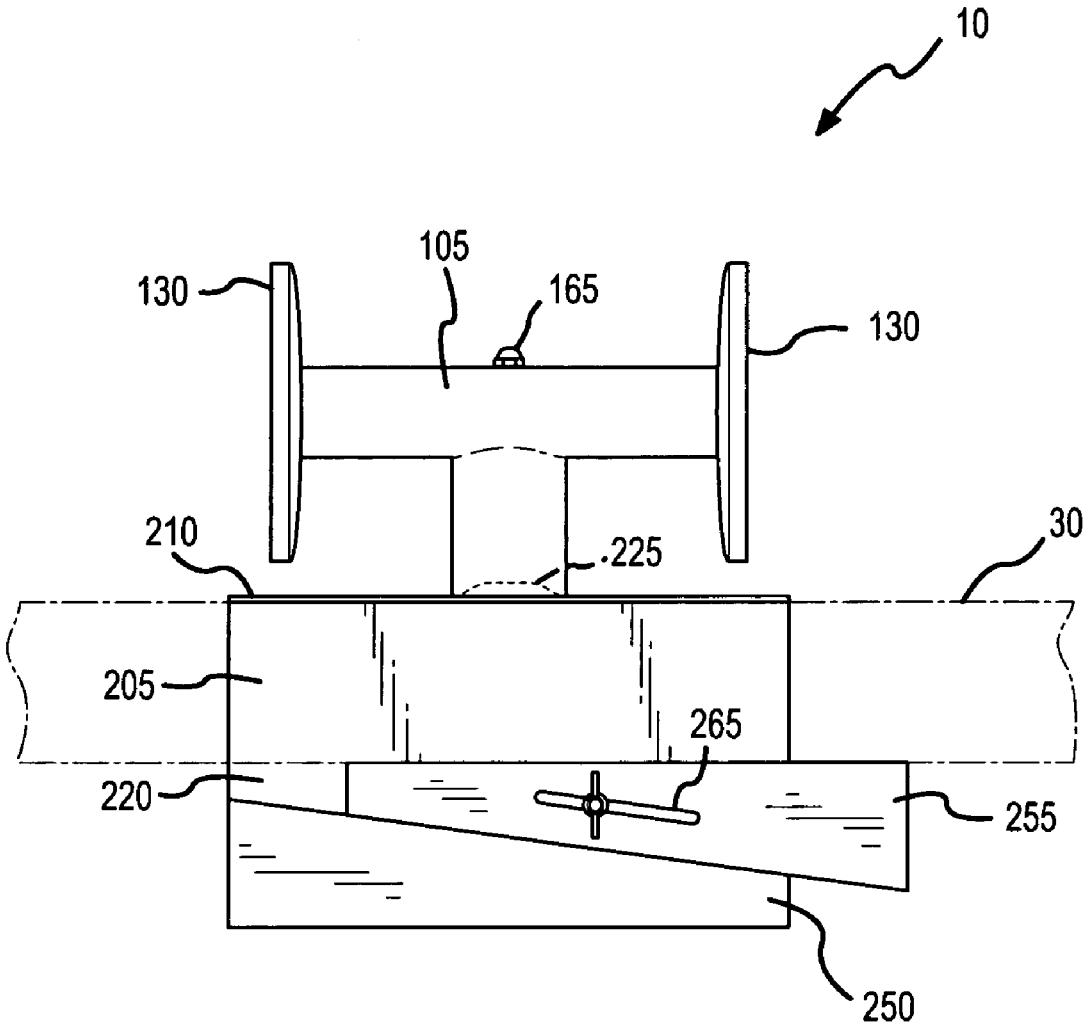
FIG. 2 is a top view of the first resistance apparatus illustrating how the device is secured to a door according to one embodiment of the present invention.

An inner wedge block 255 is located between the outer wedge block 250 and the vertical side 210 of the L-bracket 205. As illustrated, the inner wedge block is slidably attached to the L-bracket with a threaded fastener 245 that passes through a mounting hole 235 in the horizontal side 220 and an elongated slot 265 in the inner wedge block. A wing nut 275 is threaded over the end of the threaded fastener 245 and tightened in place against the inner wedge block to hold the block in a desired position. As best shown in FIGS. 2 and 3, the side or surface 270 of the inner wedge block 255 adjacent the canted surface 260 of the outer wedge block forms a shallow acute angle that is complementary to the angle of the canted surface of the outer wedge block such that the opposing side of the inner wedge block remains parallel to the vertical side as the inner block is slid against and along the outer block.

Although the inner wedge block 255 is shown in the figures as being coupled to the L-bracket member 205 by a fastener, in variations and alternative embodiments the inner and outer wedge blocks can be secured or affixed to the L-bracket in any suitable manner as would be obvious to one of ordinary skill in the art given the benefit of this disclosure. For instance, the inner wedge block need not be physically secured to the L-bracket member but rather held in place frictionally as it is wedged between the outer wedge block 250 and the adjacent face of an associated door.

Both wedge blocks can be made of any suitable material including wood, plastic or metal. In one embodiment, the wedge blocks are comprised of wood, as suitably dimensioned material from which the wedge blocks can be fabricated is inexpensive and readily available.

Figure 4:
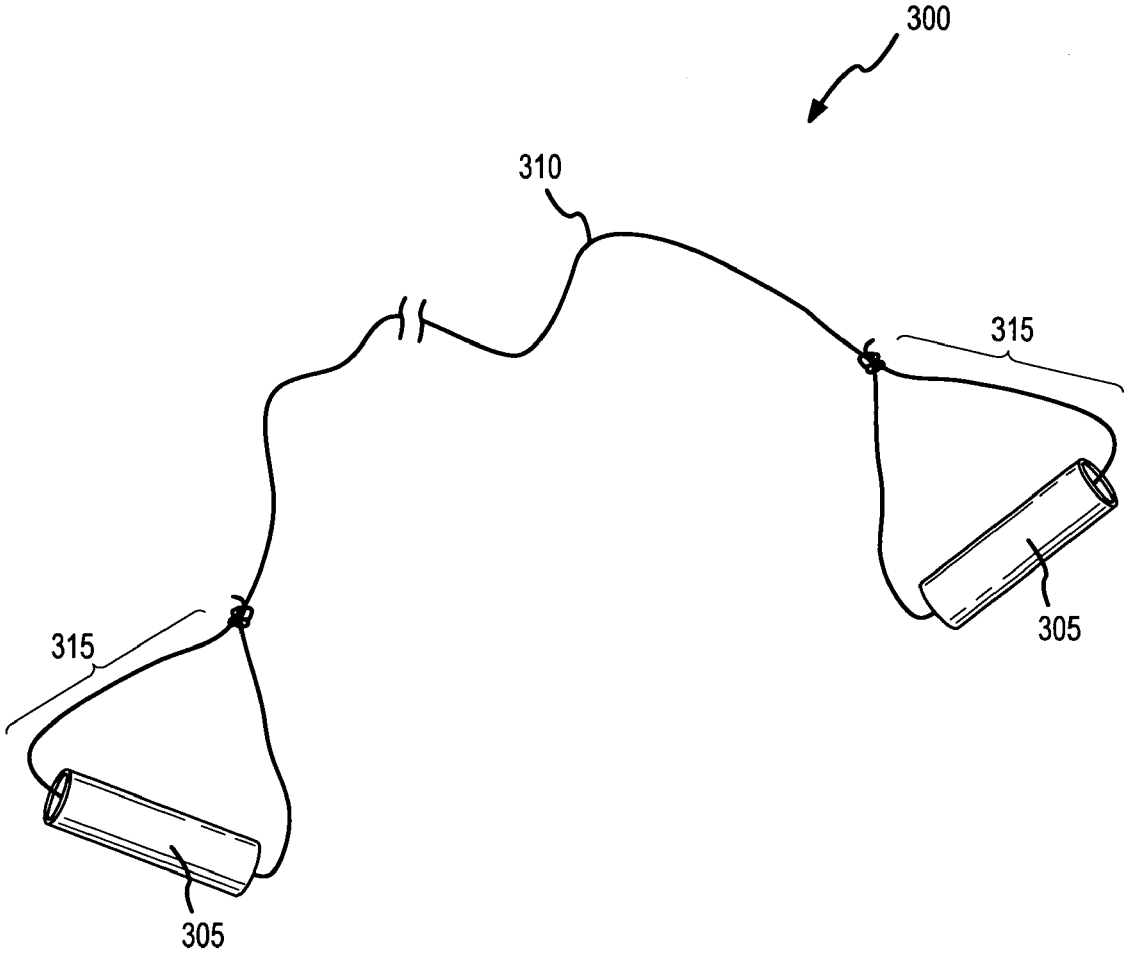
FIG. 4 is an illustration of a rope assembly according to one embodiment of the present invention.

The rope assembly 300 of the first embodiment resistance exercise device includes a flexible rope 310 typically comprised of nylon or some other suitable synthetic fiber, although in variations rope comprised of natural fibers or hybrid materials can also be used. A rigid handle assembly comprising a rigid typically straight section of conduit 305 and a looped section of rope is secured to each end of the flexible rope using any suitable means. Alternatively, a single piece of flexible rope can be used, wherein the respective ends of the rope are threaded through respective pieces of handle conduit 305 and tied back onto the rope to effectively form a handle stirrup 315 as shown in FIG. 4. Any suitable knot can be used to tie the ends of the rope but a Trucker's knot has been found to be particularly applicable as it facilitates the easy adjustment of the stirrups size. It is to be appreciated that the configuration of the rope assembly can vary substantially and significantly. For instance, handle portions that are ergonomically formed with recesses into which a user's fingers can be placed can replace the straight conduit illustrated in FIG. 4.

To set up the first embodiment exercise device, a user loosens the inner wedge block 255 and slides it outwardly of the L-bracket 205 along the canted surface 260 of the outer wedge block 250 to increase the distance between the inner surface of the inner block and the facing vertical side 210 of the L-bracket. Next, the door mount assembly 200 is slid over the horizontal top or bottom side of the door 25 (See FIG. 2). Once the device is positioned at a suitable location along the respective top or bottom side of the door, the inner wedge block is slid inwardly towards the L-bracket until it is effectively wedged between the outer wedge member and the vertical side of the L-bracket. As applicable the inner wedge is then tightened into place and the associated door is closed.

Once the device is in place on the door, the rope assembly 300 is wrapped around the T-shaped cylindrical member 105 to provide a user a desired amount of frictional resistance. To wrap the rope 310 around the T-shaped cylindrical member, the rope is slid between the edges of the respective end stops and the vertical side of the L-shaped bracket.

Referring to FIG. 7, a few possible wrap configurations are illustrated. Using a nylon rope 310 wrapped in configuration A, approximately 3.5 pounds of resistance are required by the arm performing the exercise to overcome each pound of resistance supplied by the non-exercising arm. Using configuration B, approximately 12.8 pounds of resistance are required by the arm performing the exercise to overcome each pound of resistance supplied by the non-exercising arm. Using configuration C, approximately 7 pounds of resistance are required by the arm performing the exercise to overcome each pound of resistance supplied by the non-exercising arm. Using configuration D, approximately 24 pounds of resistance are required by the arm performing the exercise to overcome each pound of resistance supplied by the non-exercising arm. Of course, many other configurations are possible such that a user can configure the exercise device for the particular exercises he/she is performing.

Figure 5:
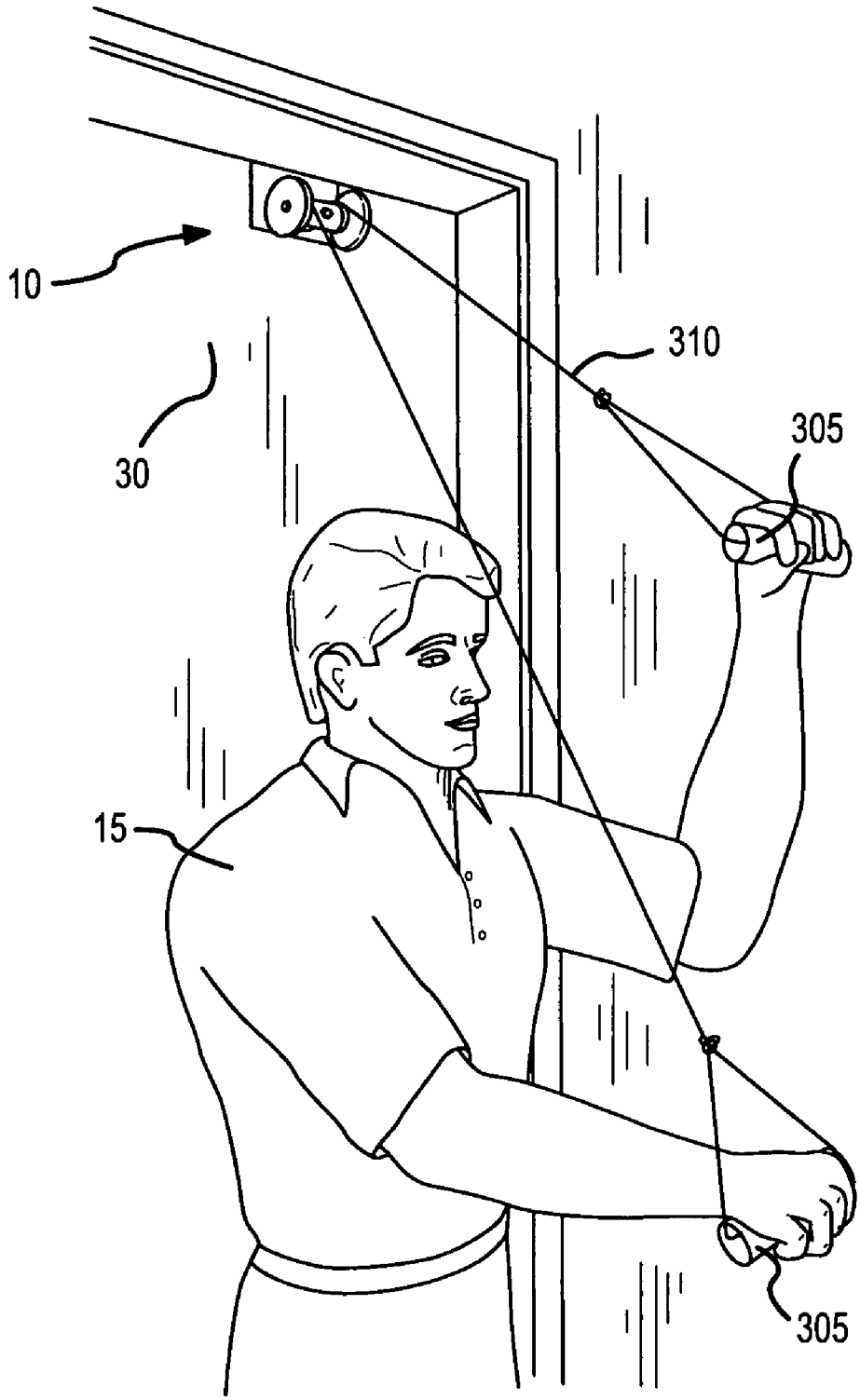
FIG. 5 is an isometric view of a person using the first resistance apparatus when the apparatus is secured to the top side of a door according to one embodiment of the present invention.
Figure 6:
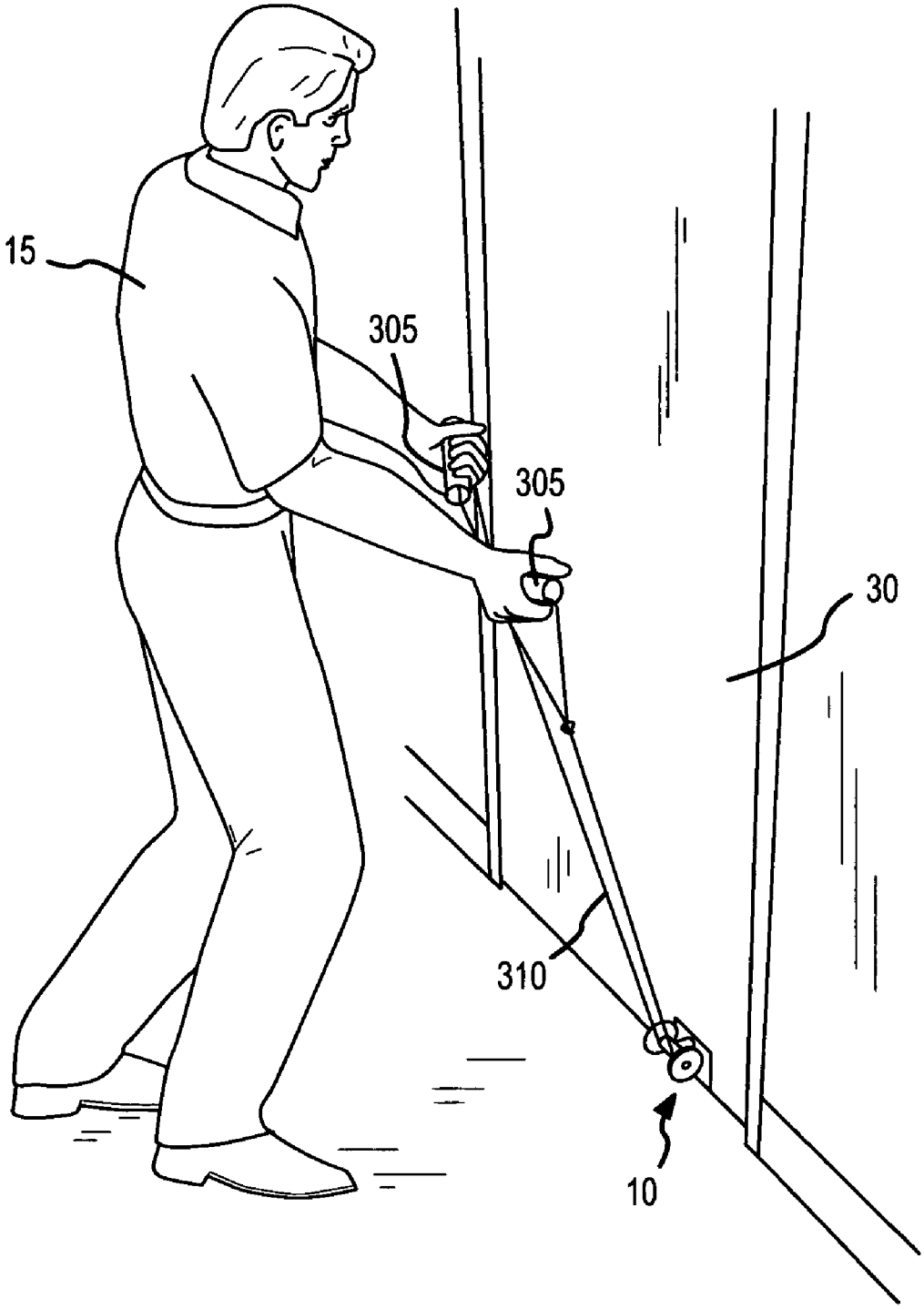
FIG. 6 is an isometric view of a person using the first resistance apparatus to perform a curl exercise when the apparatus is secured to the bottom side of a door according to one embodiment of the present invention.
Figure 7A:
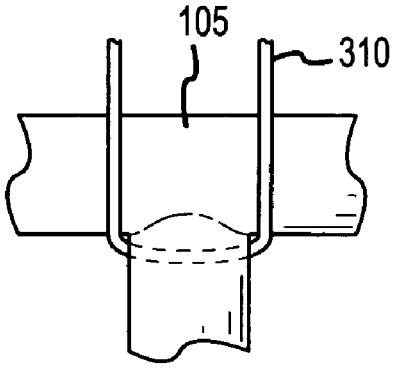
FIG. 7 is a top view of the T-shaped cylindrical member of a resistance apparatus indicating four different rope windings that provide differing resistance multiples according to one embodiment of the present invention.
Figure 7B:
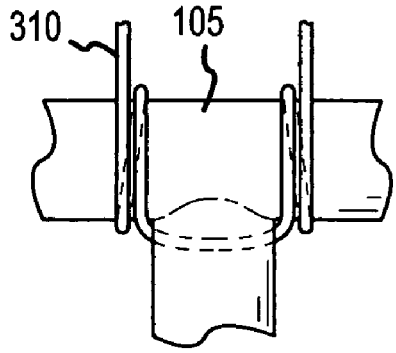
Figure 7C:
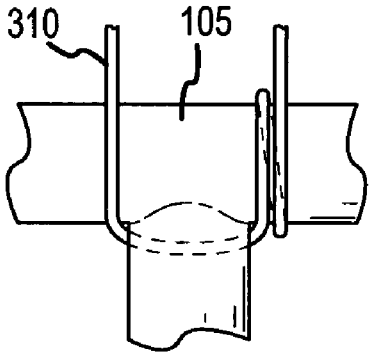
Figure 7D:
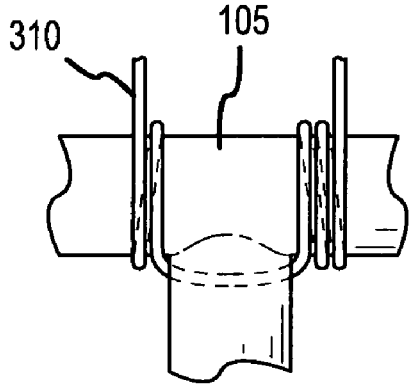

Referring to FIGS. 5&6, a user 15 is shown exercising with the first embodiment exercise device 10. In FIG. 5, the exerciser pulls the left handle 305 downwardly and forwardly with his left hand/arm while applying a variable amount of resistance with his/her right hand/arm through the right handle 305. Once the one arm is fully extended, the user then pulls the right handle downwardly and forwardly while applying a variable amount of resistance with left hand through the left handle. The process is repeated until the exerciser has completed the desired number of strokes or cycles. To perform aerobic exercise, exerciser would typically utilize a rope wrap configuration that provides a relatively low amount of resistance, such as wrap configuration A or C of FIG. 7, and the exerciser would perform a large number of cycles rapidly within a given period of time. For strength training, a higher level of resistance would be used, such as provided by wrap configurations B & D, and the number of cycles within a given period of time would be reduced significantly. It is appreciated that the exercise illustrated in FIG. 5 is merely exemplary and that other exercises can be performed with the device in the illustrated position secured to the top side 25 of a door 30.

In FIG. 6, the exerciser 15 pulls the right handle 305 upwardly in a curl motion while providing resistance with the right hand. Once the curl with the right handle is complete the process is repeated by pulling the left handle 305 upwardly in a curl motion. The rope wrap configuration will vary depending on whether the exerciser is performing aerobic or strength training. Further, the type of exercise can vary significantly as would be obvious to one of ordinary skill in the art with the benefit of this disclosure. Additionally, while not specifically illustrated herein, the first embodiment exercise device can also be attached to the vertical side 20 of a door thereby permitting an exerciser to perform other types of exercises. If desired the T-shaped cylindrical member can be rotated in the L-shaped bracket 90 degrees so the arms of the T-shaped cylindrical member are generally hortizontal.

A SECOND EMBODIMENT OF A RESISTANCE EXERCISE DEVICE

Figure 8:
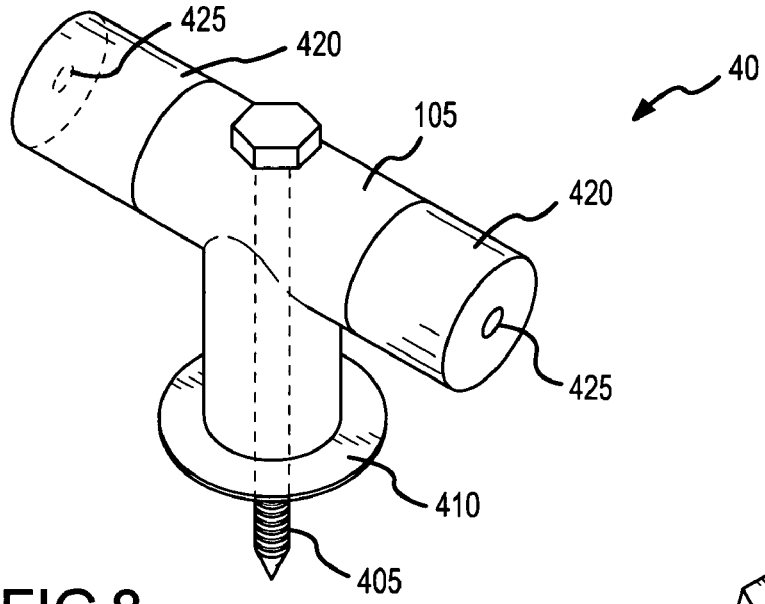
FIG. 8 is an isometric view of a second resistance apparatus according to one embodiment of the present invention.
Figure 9:
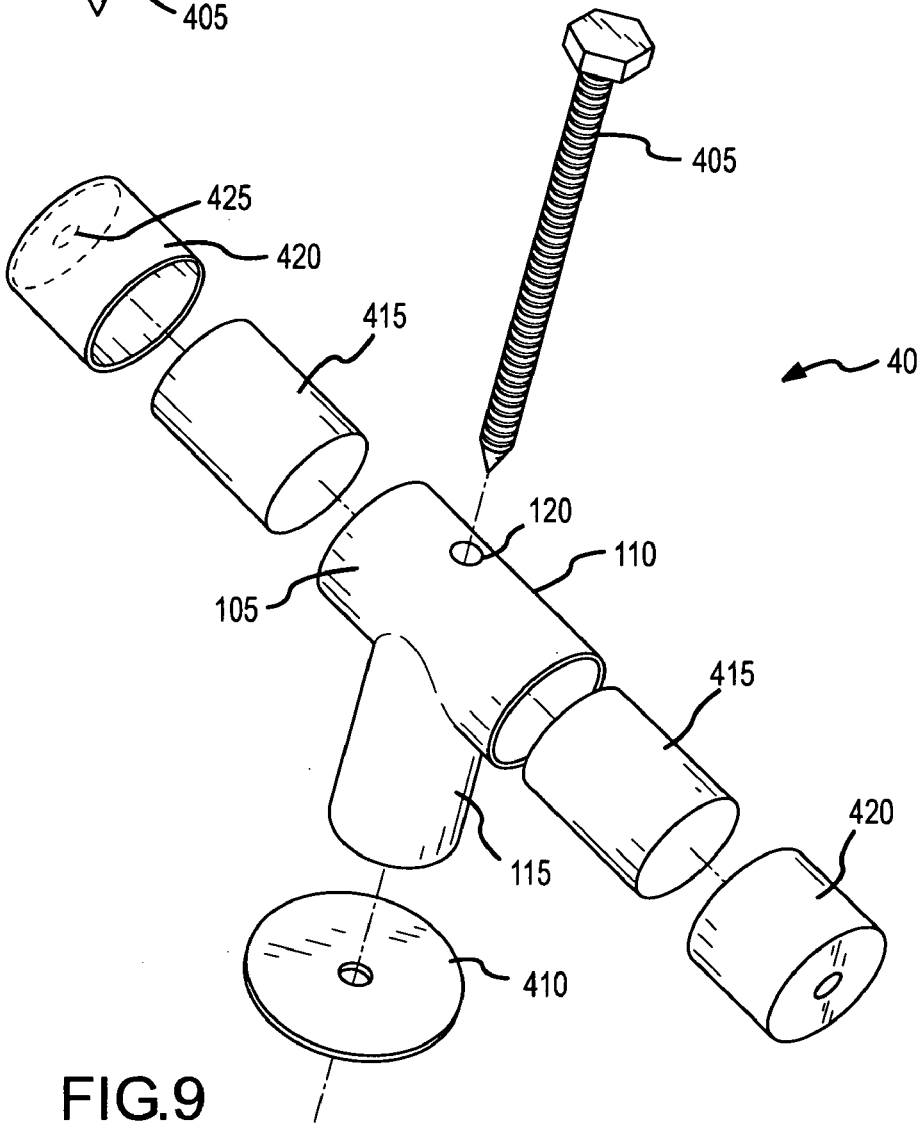
FIG. 9 is an exploded isometric view of the second resistance apparatus according to one embodiment of the present invention.

A second embodiment resistance exercise device 40 is illustrated in FIGS. 8&9. Like the first embodiment device 10, it comprises a T-shaped cylindrical member 105 around which a rope assembly 300 is wrapped to provide frictional resistance. Further, the second embodiment is operationally similar to the first embodiment. The most distinctive difference is that the second embodiment is configured to be semi-permanently secured to a surface, such as but not limited to a wall and a floor. Instead of a fastener 160 extending through the interior of the second tubular section 115 and out of the bolt hole 120, a bolt 405 typically with threads adapted to be secured into wood passes through the bolt hole 120 and extends outwardly of the bottom end of the second tubular section. A washer 410 is also typically provided that butts up against the surface on to which the second embodiment device is being secured and more evenly distribute the contact loads of the T-shaped cylindrical member's bottom end over a wider area.

The second embodiment device as illustrated does not have end stop members 130 similar to the one used in the first embodiment although similar flared stop members can be used in variations. Instead the ends of the arms of the T-shaped cylindrical member's first tubular section are capped. As best described with reference to FIG. 9, two tubular sleeves 415, such as copper sleeves commonly available for plumbing use, are partially received in the left and right ends of the first tubular section and secured therein by soldering, adhesive bonding or some other suitable means. End cap members 420 are then fitted over the protruding portions of the tubular sleeves. Like the T-shaped cylindrical member 105 and the tubular sleeves, the end cap members are typically made of copper and are commonly available for plumbing use at hardware stores. Preferably, the ends of the end caps include openings 425 wherein water can be injected into the T-shaped tubular member to assist in the cooling of the member during exercise use.

A Third Resistance Apparatus

Figure 10:
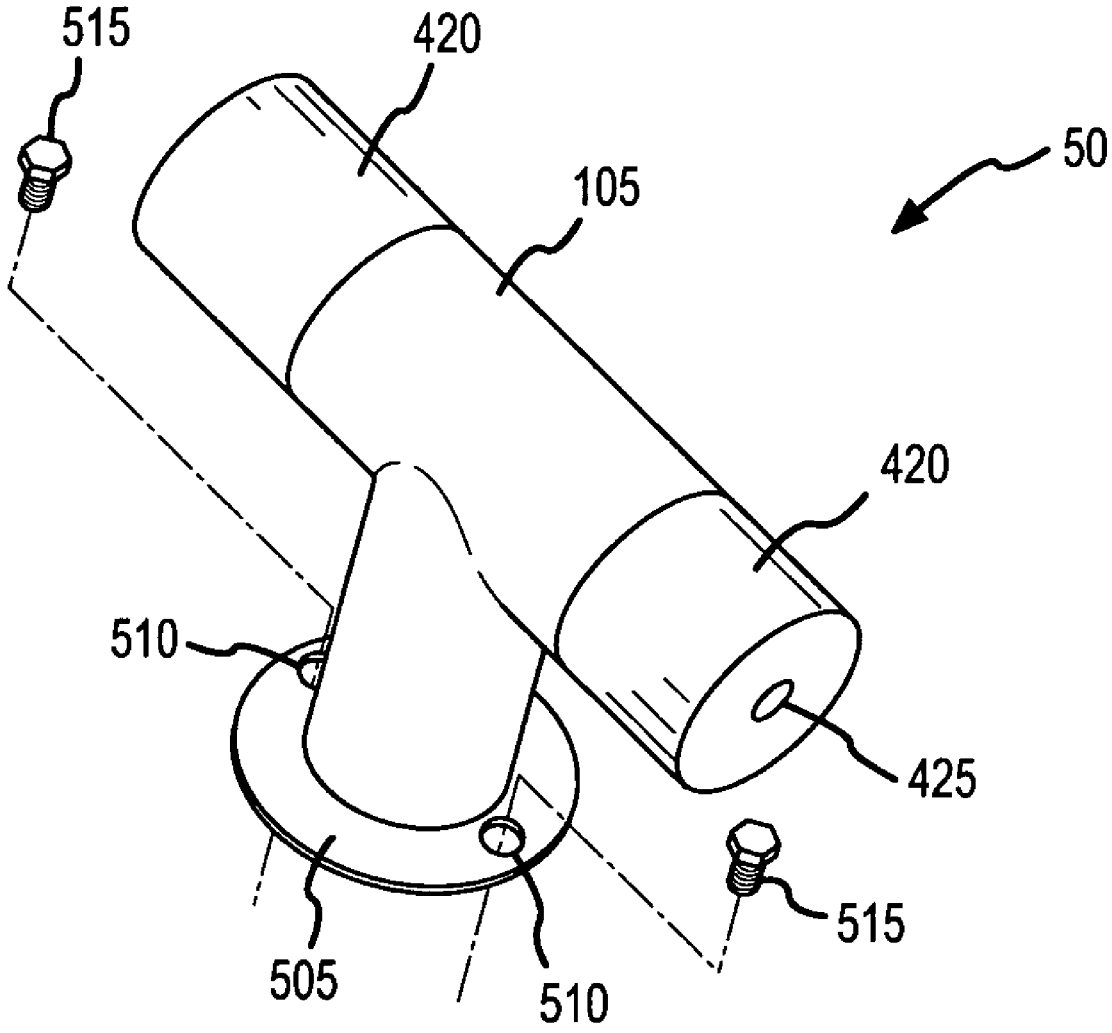
FIG. 10 is an isometric view of a third resistance apparatus according to one embodiment of the present invention.

A third embodiment resistance exercise device 50 is illustrated in FIG. 10. Like the first and second embodiment devices 10&40, it comprises a T-shaped cylindrical member 105 around which a rope assembly 300 is wrapped to provide frictional resistance. Further, the third embodiment is operationally and generally configurationally similar to the first embodiment. The third embodiment, however, does away with the bolt 405 of the second embodiment. Rather, the third embodiment device is attached to a surface using two fasteners 515 that pass through bolt holes 510 in a washer 505 that is fixedly secured to the T-shaped cylindrical member's bottom end. The washer member can be secured to the T-shaped cylindrical member by any suitable means such as but not limited to welding, brazing and adhesive bonding.

ALTERNATIVE EMBODIMENTS AND OTHER VARIATIONS

The embodiments of the exercise device as illustrated in the accompanying figures and described above are merely exemplary and are not meant to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

In alternative embodiments and variations, the actual configuration of the door mount assembly can vary significantly. For instance the wedge blocks can be replaced with a single block that slides inwardly and outwardly relative to the vertical side of the L-bracket and can be fixed in any desired position. In other embodiments, the manner of attaching the inner wedge block to the device can vary as mentioned above. In yet other embodiments, the configuration and appearance of the L-shaped bracket may vary significantly.

In other alternative embodiments, the T-shaped cylindrical member assembly can vary significantly as well. For instance, while the T-shaped member is hollow in the illustrated, a solid member is also contemplated wherein the end stop fasteners are threaded directly into threaded bores in the T-shaped cylindrical member. Further, another threaded bore can be provided so that the mounting bolt used to secure the member to the L-shaped bracket is directly threaded into the other bore. Of course, the end stops on the first embodiment device can be replaced with end caps similar to those used in the second and third embodiments.

Further, while the embodiments of the exercise device described herein are configured for use without any additional weights or other resistance means, it is appreciated that the device can be adapted for use with a weight. For instance, instead of using one hand/arm to apply a resistance load an appropriately configured weight could be used in place thereof.

I claim:

1. A frictional resistance exercise device for attaching to a door comprising;

a rope having first and second ends, the first end including a first hand grip;

a T-shaped cylindrical member with an exterior surface around which the rope is wrapped;

a door mount assembly to which the first T-shaned cylindrical member is coupled, the door mount assembly being adapted to removably fit over an edge of the door and allow the door to be closed in an associated door frame when attached to the door; and left and right circular end stop members, each end stop member having a diameter significantly greater than the diameter of the first tubular section at the respective left or right end;

wherein the T-shaped cylindrical member includes a first tubular section having left and right ends and a second tubular section extending generally perpendicularly from the first tubular section proximate a longitudinal midpoint of the first tubular section.

2. The exercise device of claim 1, wherein each end stop device includes a fastener hole, the fastener hole (i) being located radially of a center point of the end stop, and (ii) including a fastener therethrough wherein the fastener is rotatably couples the end stop to the respective left or right end of the first tubular section.

3. A frictional resistance exercise device for attaching to a door comprising:

a rope having first and second ends, the first end including a first hand grip;

a T-shaped cylindrical member with an exterior surface around which the rope is wrapped; and a door mount assembly to which the first T-shaped cylindrical member is coupled, the door mount assembly being adapted to removably fit over an edge of the door and allow the door to be closed in an associated door frame when attached to the door;

wherein the second tubular section includes a distal end and wherein the door mount assembly includes an L-shaped bracket, the L-bracket having first and second side sides, each side having inside and outside faces, the distal end being secured to the outside face of the first side of the L-bracket; and wherein the T-shaped cylindrical member includes a first tubular section having left and right ends and a second tubular section extending generally perpendicularly from the first tubular section proximate a longitudinal midpoint of the first tubular section.

4. The exercise device of claim 3, wherein the L-shaped bracket has a thickness of generally less than 0.125".

5. The exercise device of claim 3, wherein the door mount assembly further includes a first wedge block having an first inside surface and a first outside surface, the first inside surface generally facing the inside face of the first side of the L-bracket, the first inside surface being spaced from the inside face.

6. The exercise device of claim 5, wherein the door mount assembly further includes a second wedge block, the second wedge block having a second inside surface and a second outside surface, the second inside surface facing and being substantially parallel to the first inside surface of the first side, the first inside surface and the second outside surface being parallel to each other and forming acute angles with the first side, the second wedge block being adapted to slide between the first side and the first inside face in a direction generally along the first face.

7. The exercise device of claim 3, further comprising an elongated threaded fastener and a threaded nut the threaded fastener extending through (i) a bolt hole in the first side of the L-bracket, (ii) an interior of the second tubular section, and (iii) another bolt hole in the first tubular section, the threaded nut being secured around the threaded fastener proximate one end thereof to secure the T-shaped cylindrical member to the L-shaped bracket.

8. The exercise device of claim 2, further comprising a coupler with a threaded interior, the coupler being located in an interior of the first tubular section and having (i) the fastener of the left end stop threadably received in a left side of the coupler and (ii) the fastener of the right end stop threadably received in a right side of the coupler.

9. The exercise device of claim 8, wherein the coupler further includes a bore extending through coupler generally perpendicularly to the threaded interior.

* * * * *